US005158296A

United States Patent [19]

Lee

[11] Patent Number: 5,158,296

[45] Date of Patent: Oct. 27, 1992

[54] GOLF CLUB

[76] Inventor: Kunsam Lee, 13609 S. Normandie Ave., Gardena, Calif. 90249

[21] Appl. No.: 760,371

[22] Filed: Sep. 16, 1991

[51] Int. Cl.[5] ..... A63B 53/04

[52] U.S. Cl. ..... 273/167 E; 273/167 J

[58] Field of Search ..... 273/167–175, 273/77 R, 164, 193 R, 194 R; D21/214, 215, 216

[56] References Cited

U.S. PATENT DOCUMENTS

| | | | |
|---|---|---|---|
| 780,776 | 1/1905 | Brown | 273/167 E |
| 922,444 | 5/1909 | Youds | 273/77 R |
| 1,336,671 | 4/1920 | Backus | 273/167 E |
| 1,414,124 | 4/1922 | Griffin | 273/167 E |
| 1,697,846 | 1/1929 | Anderson | 273/167 E |
| 3,468,544 | 9/1969 | Antonious | 273/167 E |
| 3,794,328 | 2/1974 | Gordon | 273/167 E |
| 3,819,180 | 6/1974 | Murphy | 273/167 E X |
| 4,065,133 | 12/1977 | Gordos | 273/167 E |
| 4,809,982 | 3/1989 | Kobayashi | 273/167 E |
| 4,869,508 | 9/1989 | Miller | 273/167 E X |
| 5,054,784 | 10/1991 | Collins | 273/167 E |

FOREIGN PATENT DOCUMENTS

| | | | |
|---|---|---|---|
| 642134 | 6/1962 | Canada | 273/167 E |
| 312761 | 6/1929 | United Kingdom | 273/77 R |
| 322635 | 12/1929 | United Kingdom | 273/169 |
| 854249 | 11/1960 | United Kingdom | 273/167 E |

*Primary Examiner*—Vincent Millin
*Assistant Examiner*—Sebastiano Passaniti
*Attorney, Agent, or Firm*—Roger A. Marrs

[57] ABSTRACT

A golf club is disclosed herein of the driver type having a golf ball engaging head with a central plate located at the commonly referred to area as the "sweet spot" with a surrounding flat edge marginal region extending to the top and bottom of the head. A plurality of open-ended passageways extends in fixed parallel spaced-apart relationship through the edge marginal region about the plate from the front of the head to the rear thereof. The undersurface or bottom is aerodynamically configured so that oncoming air flow (ram air) is conducted through the open passageways and around the top and bottom of the head as the club is swung by the golfer whereby air resistance and surface friction is reduced.

1 Claim, 1 Drawing Sheet

GOLF CLUB

BACKGROUND OF THE INVENTION

1. Field of the Invention

The present invention relates to the field of athletic equipment and, in particular, to a novel golf club having a ball-striking head which is provided with open-ended passageways in order to conduct ram air through the head in order to reduce friction and drag as the club is swung by a golfer.

2. Brief Description of the Prior Art

In the past, it has been the conventional practice to provide a golf club having an elongated shaft which is held in the hand of a golfer at one end and a ball-striking head at its other end. The usual design and construction of the golf club head, particularly for a driver, includes a weighted mass having a front or forward flat surface intended to impact against a golf ball as the golfer swings the club. In some instances, a circular plate is carried on the forward flat surface which is located in a special area known as the "sweet spot". Surrounding the "sweet spot" area is a flat surface against which the oncoming ram air impacts with the result that drag and friction slows the speed of the golfer's swing and therefore limits the forcible impact of the golf club head against the golf ball. Such a reduction in golf club swing speed greatly limits the distance that the ball may be driven from its starting point on a golf tee.

Some attempts have been made to reduce drag and friction by streamlining and aerodynamically shaping the golf club head so that laminar air flow about the outer surfaces of the head will reduce friction. However, the broad flat surface on the front of the golf club head is a major speed limiting factor since the air resistance against the flat surface greatly increases drag during the golfer's swing.

Therefore, a long-standing need has existed to provide a novel golf club head, particularly of the driver type, which includes means for reducing drag and for conducting oncoming ram air around or through the weighted mass of the club head so that friction and drag are eliminated or greatly reduced.

SUMMARY OF THE INVENTION

Accordingly, the above problems and difficulties are obviated by the present invention which provides a novel golf club head which includes a weighted mass having aerodynamic configuration across the top and bottom or undersurface of the mass extending from a broad flat surface in front to a tapered rear portion of the mass. A plate is carried on the broad flat front surface of the mass which defines an edge marginal region of the mass surrounding the plate and merging with the top and bottom of the mass. At least a single continuous row of a plurality of open-ended passageways is provided through the defined edge marginal region extending from the broad flat surface through the mass for exiting at the rear thereof. The passageways are arranged in fixed spaced-apart parallel relationship and are intended to conduct oncoming ram air through the mass of the club head as it is swung by the golfer. The passageways are unrestricted so that clear flow of ram air will pass through augmenting the speed at which the golf club can be swung by the golfer. Such increase in speed will develop increased striking or impact force against the golf ball in order to gain added distance.

Therefore, it is among the primary objects of the present invention to provide a novel golf club having an aerodynamically shaped head of suitable mass that incorporates open-ended passageways for conducting ram air through the mass.

Another object of the present invention is to provide a novel golf club having a head incorporating anti-friction and anti-drag means so that the speed of swing by the golfer is greatly increased, resulting in great impact against the golf ball in order to gain greater travel or distance during a golf driving procedure.

Still another object of the present invention is to provide a novel means for increasing the speed of golf club swing so that a golf ball may be driven farther than can ordinarily be gained.

Yet another object of the present invention is to provide a novel golf club having a plurality of passageways extending in fixed parallel relationship through the mass of the club head so that the "sweet spot" of the head is not interfered with and whereby drag and friction are greatly reduced or eliminated.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
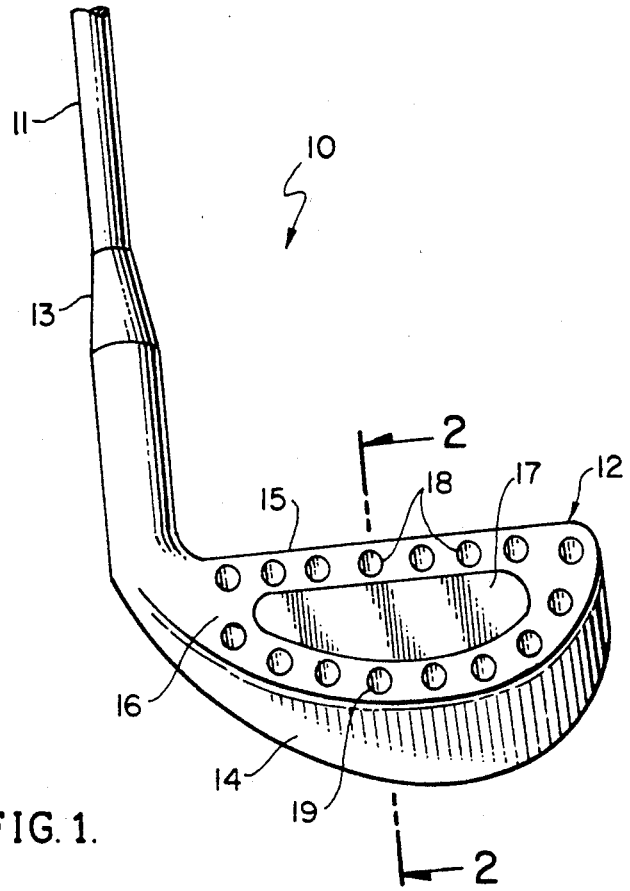
FIG. 1 is a front elevational view of a golf club head of the driver type incorporating the anti-friction and anti-drag means of the present invention.

Referring to FIG. 1, the novel golf club of the present invention is indicated in the general direction of arrow 10 which includes an elongated shaft 11 having a golfer's hand grip at one end (not shown) and a golf club head 12 at its other end. The head 12 includes a substantial mass since the golf club itself is of the driver type. The head 12 is secured to the end of shaft 11 by means of a conventional crimp, or other type connection, broadly indicated by numeral 13.

The club head 12 includes an aerodynamically shaped undersurface 14 and a flat top surface 15 which merge with a front flat surface 16 that is intended to be forcibly impacted against a golf ball positioned on a golf tee in a usual driving procedure. The head 12 further includes a flat metal oblong plate 17 which is carried in a central location on the flat frontal surface 16 and the plate is in a critical position, generally referred to as the "sweet spot" of the club head 12. In this location, it is preferred that the golf ball be impacted or struck at this spot in order to obtain maximum drive or distance of the ball.

In accordance with the primary objective of the present invention, surface friction or tension is broken by providing a plurality of open-ended passageways or holes which extend from the flat frontal surface 16 to the rearmost backside of the head 12.

Figure 2:
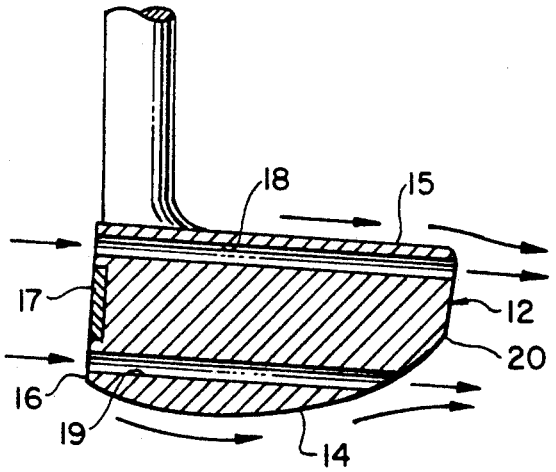
FIG. 2 is a transverse cross-sectional view of the golf club head shown in FIG. 1 as taken in the direction of arrows 2—2 thereof.

Referring to FIGS. 1 and 2, the open-ended passageways are indicated by numerals 18 and 19 as examples of the plurality of passageways extending through the entire mass of the head 12. It can be seen in FIG. 2 that the open-ended passageways are provided in an edge marginal region of the head mass surrounding the plate 17. In some instances, it may be desirable to include the passageways through the plate 17 as well as through the mass of the club head itself. An edge marginal region is defined between the periphery of the plate 17 and the top surface 15, as well as the aerodynamic undersurface 14. The passageways are provided in the edge marginal region surrounding the plate.

As shown in detail in FIG. 2, the arrows represent oncoming ram air which is conducted about the top surface 15 and the undersurface 14 to reduce aerodynamic friction and to increase air flow around the head mass. Also, the arrows indicate that the oncoming ram air will pass through the mass via the open-ended passageways. The ram air enters the passageways from the frontal surface 16 and is exhausted or exits through the other end of the passageway at the rear surface of the head mass, indicated by numeral 20. The broad flat frontal surface is of a lesser dimension between the top surface and the undersurface than the dimension of the top surface between the frontal surface and the rear surface.

In view of the foregoing, it can be seen that the novel golf club head of the present invention will provide a golfer with increased swing speed because of the aerodynamic changes incorporated into the head mass by the present invention. It is estimated that a golfer may achieve up to 20 to 30 additional yards in ball travel through the use of the present invention. The provision of the open-ended passageways in combination with the aerodynamic configuration of the head mass reduces surface friction and resistance in order to gain speed of the golf club during a swinging procedure. The holes or passageways break air tension at the surface so that drag or friction on the club head due to surface tension is eliminated or reduced.

In some instances, it may be desirable to use different diameter of passageways among the plurality and such a provision is part of the present invention. Also, it is to be understood that double or more rows of open-ended passageways may be provided and that holes or passageways may also be incorporated into the plate 17.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A golf club of the driver type comprising:

an elongated shaft having a hand-gripping end and a club head carried on an end opposite said hand-gripping end;

said club head comprising a weighted mass having a broad flat frontal surface with a curved aerodynamic undersurface and a broad flat top surface terminating with a rear surface;

said broad flat frontal surface being of lesser dimension between said top surface and said undersurface than the dimension of said top surface between said frontal surface and said rear surface;

a plurality of open-ended passageways extending through said club head mass from said flat frontal surface to said rear surface;

said passageways being in a single continuous row of spaced-apart individual passageways each being of constant cross-sectional diameter and adapted to conduct oncoming ram air through said club head mass thus reducing friction, surface tension, and drag;

said passageways conducting said oncoming ram air completely through said club head mass from said flat frontal surface to said rear surface;

said flat frontal surface including an edge marginal region surrounding a central portion;

said continuous row of open-ended passageways disposed through said edge marginal region about said central portion;

an oblong ball impact plate carried on said central portion of said flat frontal surface surrounded by said passageways;

said club head frontal surface edge marginal region providing a reduced area as compared with the area of said impact plate whereby said single row of open-ended passageways is arranged about and around said impact plate in a series of adjacent ones of said open-ended passageways.

said club head mass undersurface being curved and extending between said frontal surface and said rear surface;

said club head weighted mass being structurally unweakened by said single row of passageways.

* * * * *